US007348721B2

(12) United States Patent
Hirasawa et al.

(10) Patent No.: US 7,348,721 B2
(45) Date of Patent: Mar. 25, 2008

(54) DISPLAY DEVICE

(75) Inventors: Shigemi Hirasawa, Chiba (JP); Tomoki Nakamura, Chiba (JP); Yuuichi Kijima, Chosei (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 0 days.

(21) Appl. No.: 11/583,774

(22) Filed: Oct. 20, 2006

(65) Prior Publication Data

US 2007/0035233 A1 Feb. 15, 2007

Related U.S. Application Data

(63) Continuation of application No. 10/739,341, filed on Dec. 19, 2003, now Pat. No. 7,129,630.

(30) Foreign Application Priority Data

Dec. 19, 2002 (JP) ..... 2002-368182

(51) Int. Cl.
*H01J 1/62* (2006.01)
*H01J 63/04* (2006.01)

(52) U.S. Cl. ..... 313/495; 313/558; 313/559

(58) Field of Classification Search ..... 313/549, 313/558–561, 495

See application file for complete search history.

(56) References Cited

U.S. PATENT DOCUMENTS

| | | | | |
|---|---|---|---|---|
| 3,920,355 | A * | 11/1975 | Zucchinelli | 417/49 |
| 5,656,889 | A * | 8/1997 | Niiyama et al. | 313/553 |
| 6,100,627 | A | 8/2000 | Carretti et al. | |
| 6,114,806 | A | 9/2000 | Itoh | |
| 6,400,074 | B1 | 6/2002 | Yamaura et al. | |
| 6,452,322 | B1 * | 9/2002 | Mukuno et al. | 313/481 |
| 6,838,822 | B2 | 1/2005 | Yonezawa | |

* cited by examiner

*Primary Examiner*—Ashok Patel
(74) *Attorney, Agent, or Firm*—Antonelli, Terry, Stout & Kraus, LLP.

(57) ABSTRACT

A display device is disclosed for providing improved brightness and definition. The device includes a substrate which has anodes and phosphors formed on an inner surface thereof and a plurality of cathode lines that extend in one direction and include electron sources. Control electrodes are provided in a display region in a non-contrast manner. The control electrodes are formed on an inner surface of a back substrate and arranged to face a face substrate in an opposing manner. A support body is interposed between the face substrate and the back substrate such that the support body surrounds the display region and maintains a given distance. The device also includes a plurality of getters arranged between the support body and the partition wall body.

11 Claims, 13 Drawing Sheets

1
2
3
4
5
5a
6
6a
7
8
9
10
24
40
61
71
72
91
A
AR

DISPLAY DEVICE

CROSS REFERENCE TO RELATED APPLICATION

This application is a continuation of U.S. application Ser. No. 10/739,341, filed Dec. 19, 2003, now U.S. Pat. No. 7,129,630 the contents of which are incorporated herein by reference.

BACKGROUND OF THE INVENTION

The present invention relates to a display device which utilizes an emission of electrons into a vacuum space, which is defined between a face substrate and a back substrate; and, more particularly, the invention relates to a display device in which those are cathode lines having electron sources and control electrodes which control a quantity of electrons led out or emitted from the electron sources, and, at the same time, to a display device which exhibits stable display characteristics by maintaining a vacuum between the front substrate and the back substrate.

As a display device which exhibits high brightness and high definition, color cathode ray tubes have been popularly used conventionally. However, with the recent demand for the production of higher quality images in information processing equipment or television broadcasting, there has been an increasing demand for planar displays (panel displays) which are light in weight and require a small space, while exhibiting a high brightness and a high definition.

As typical examples, liquid crystal display devices, plasma display devices and the like have been put into practice. Further, more particularly, as display devices which can realize a higher brightness, it is expected that various kinds of panel-type display devices, including a display device which utilizes an emission of electrons from electron sources into a vacuum and is referred to as an electron emission type display device or a field emission type display device and an organic EL display, which is characterized by low power consumption, will be commercialized.

Among such panel type display devices, as an example of the above-mentioned field emission type display device, a display device having an electron emission structure, which was developed by C. A. Spindt et al, a display device having an electron emission structure of a metal-insulator-metal (MIM) type, a display device having an electron emission structure which utilizes an electron emission phenomenon based on a quantum theory tunneling effect (also referred to as "surface conduction type electron source,), and a display device which utilizes an electron emission phenomenon having a diamond film, a graphite film and carbon nanotubes and the like have been known.

Among these panel type display devices, the field emission type display device is formed by laminating a front panel, in which an anode electrode and a fluorescent material layer on an inner surface thereof, and a back panel, in which electron emission type cathodes and grid electrodes, which constitute a control electrode, are formed on an inner surface thereof with a distance of not less than 0.5 mm, for example, therebetween, wherein a sealed space is formed between both panels and the sealed space is evacuated to a pressure lower than an ambient atmospheric pressure or to a vacuum.

Recently, the use of carbon nanotubes (CNT) as a field emission electron source, which constitutes the cathodes of this type of planar display, has been studied. Carbon nanotubes are an extremely thin needle-like compound (more particularly, a so-called graphene sheet in which carbon atoms are coupled in a hexagonal shape is formed in a cylindrical shape). A carbon nanotube assembly which is formed by collecting a large number of carbon nanotubes is fixed to a cathode electrode. By applying an electric field to the cathode electrode formed of the carbon nanotubes, it is possible to emit electrons of high density from the carbon nanotubes at a high efficiency, whereby it is possible to constitute a flat panel display which is capable of displaying images of high brightness by exciting a phosphor with these electrons.

FIG. 13 is a schematic diagram illustrating the basic structure of a field emission type display device. CNT indicates the carbon nanotubes that are formed on a cathode (cathode electrode) K, A indicates an anode (anode electrode), and a phosphor PH is formed on an inner surface of the anode A. A grid electrode G, which controls the emission of electrons, is formed in the vicinity of the cathode K, and a voltage Vs is applied between the cathode K and the grid electrode G so as to emit electrons from the carbon nanotubes CNT. By applying a high voltage Eb between the cathode K and the anode A, the electrons e that are emitted from the carbon nanotubes CNT are accelerated, and the phosphor PH is excited, whereby a colored light L, which is dependent on the composition of the phosphor PH, is irradiated. Then, by controlling the quantity of electrons which are emitted based on the modulation voltage Vs applied to the grid electrode G disposed in the vicinity of the cathode K, for example, the brightness of the colored light L can be controlled.

FIG. 14 is a diagrammatic cross-sectional view illustrating an example of a field emission type display device. In this field emission type display (FED) device, a back substrate 1 which is formed of a glass plate, and a face substrate 2, which is also formed of a glass plate, are laminated to each other by way of a frame-like support body 3, which is interposed between both substrates. The support body 3 has a height of approximately 1 mm, for example, and it surrounds a display region so as to maintain a given distance between both substrates 1, 2. Further, the inside hermetic space is evacuated and sealed. Cathode lines 13, insulation layers 14 and grid electrodes 15 are formed on an inner surface of the back substrate 1, while anode electrodes 11 and phosphors 12 are formed on the face substrate 2. Carbon nanotubes of electron sources (not shown in the drawing) are provided on the cathode lines 13.

FIG. 15 is a diagrammatic plan view as seen from the back substrate 1 side of the field emission type display shown in FIG. 14. In the inside of the effective display region AR on the inner surface of the face substrate 2, phosphors R, G, B of three colors are arranged. In this example, respective pixels are defined by partitions 16. In a monochromic display, all phosphors are formed to have the same color.

With respect to a panel display which is constituted of two panels, as described above, a plasma display (PDP) or a panel display (MIM-FED) having a metal-insulator-metal field emission source has the same constitution. Although the explanation of the present invention will be directed hereinafter to a FED device as an example, the present invention is also applicable to a PDM device and a MIM-FED device. Further, the present invention is also applicable to a display device using surface conductive elements.

As an example of this type of panel display device, patent literature 1 (Unexamined Published Patent Japanese Application No. 2000-149788) discloses a device in which a getter housing chamber is separately provided to make up for a small evacuation conductance. Further, a technique which prevents the absorption of gas into the getter by introducing an inert gas into a high-temperature exhaust gas is disclosed in patent literature 2 (Unexamined Published Japanese Patent Application No. 2002-75202). Further, a proposal which carries out sealing and evacuation in a vacuum chamber is disclosed in patent literature 3 (Unexamined Published Japanese Patent Application No. 2002-56777). Further, a device which is further provided with getter support members, which control the scattering direction of the getter flash, is disclosed in the patent literature 4 (Unexamined Published Japanese Patent Application No. 2002-42638).

SUMMARY OF THE INVENTION

The above-mentioned electron emission type display device employs a system in which electrons emitted from the electron source pass through apertures formed in the control electrodes and impinge on phosphors which constitute the anodes, so as to excite the phosphors and generate light. This display device provides an excellent structure, which is light weight and produces space-saving planar display, while having excellent characteristics, such as high brightness and high definition. However, in spite of such excellent characteristics, the display device still has problems to be solved. That is, in a flat panel display, such as a FED device or the like, in which there is a relatively large distance between the face substrate and the back substrate, the melting treatment applied to a sealing mechanism for holding the lamination distance between both substrates to a given value becomes important.

Further, in a flat panel display device having a broad display region, the evacuation treatment which reduces the pressure in the hermetic space defined by the face substrate, the back substrate and the support body, or creates a vacuum in the hermetic space, becomes important. In this regard, the above-mentioned patent literature 3 proposes a fabrication method in which, at the time of forming the hermetic space by melting a sealing material which is inserted between both substrates and the support body along with the above-mentioned evacuation treatment, the whole flat panel display device is subjected to a heating treatment using a baking furnace. However, when the melting and the evacuation are performed such that the distance between the face substrate and the back substrate assumes a given value from the beginning, since the conductance of the hermetic space is small, there arises a drawback in that sufficient evacuation becomes difficult, whereby a desired degree of vacuum cannot be obtained.

This drawback leads to the shortening of the lifetime characteristics of the device when the degree of vacuum is not sufficient with respect to a FED device or a plasma display device which uses carbon nanotubes, for example, as electron emission sources, thus lowering the reliability of the product. Accordingly, the assurance of the desired degree of vacuum is a most crucial task to be solved.

Further, in a MIM-FED device, when the high-temperature treatment is applied to the inner surface of the panel, a so-called hillock is liable to be easily generated, and, hence, the rate of production of defects is increased. Further, even when carbon nanotubes are used as the electron emission source, when the treatment temperature is high, there arises a drawback in that the whole or a portion of the carbon nanotubes is dissipated. Further, in the method disclosed in patent literature 3, there arises a drawback in that a huge evacuation device becomes necessary.

In the manufacturing method disclosed in the patent literature 1, which is directed to a device in which the getter housing chamber is provided separately, a vacuum chamber is used in the evacuation treatment, and, hence, it is difficult to apply the method to a large-sized display. On the other hand, in the manufacturing method disclosed in patent literature 2, in which an inert gas is introduced in a sealing step, due to the gas absorption and evacuation characteristics of the constitutional members of the device, there exists a possibility that these constitutional members will again absorb a residual gas, thus giving rise to a problem with respect to the assurance of a desired degree of vacuum. Further, minute apertures remain in the melt sealing member, and, hence, it is difficult to ensure the reliability of hermetic sealing, whereby there arises a drawback in that the assurance of the degree of vacuum becomes further difficult.

Further, in the device disclosed in the patent literature 4, which provides a getter support member for controlling the scattering direction of the getter flashing, there exists the possibility that the getter flashing per se becomes difficult due to the structure of the getter support member, and there also arises a problem with respect to the assurance of fixing of the getter support member due to thermal damage caused by overheating at the time of heating the getter.

Thus, it is an object of the present invention to solve these drawbacks together with the previously-mentioned various drawbacks, such as the difficulty in the assurance of a degree of vacuum which can obtain desired characteristics.

Accordingly, it is an object of the present invention to provide a display device having a long lifetime which can ensure a desired degree of vacuum by solving the above-mentioned various drawbacks.

To achieve the above-mentioned objects, the present invention is characterized in that a partition wall body is arranged between a support body and an electrode, and getters are fixedly arranged in a space defined between the partition wall body and the support body. Further, the present invention is characterized in that getters are arranged between a support body and electrodes, and the electrodes are covered with an insulation film. Hereinafter, representative examples of the display device of the present invention will be described.

The display device according to the present invention comprises a face substrate, having anodes and phosphors formed on an inner surface thereof, and a back substrate having a plurality of cathode lines which extend in one direction and are arranged in parallel in another direction which crosses the one direction and include electron sources, and control electrodes which cross the cathode lines in a display region in a non-contact manner and which have electron passing apertures for allowing electrons emitted from the electron sources to pass through the control electrodes to the face substrate side. The back substrate is disposed so as to face the face substrate in an opposed manner with a given distance therebetween, and a support body is interposed between the face substrate and the back substrate so that the support body surrounds the display region and maintains a given distance between the substrates. A sealing material is disposed so as to hermetically seal the end faces of the support body and the face substrate and the back substrate, respectively, and getters are fixedly arranged between the support body and a partition wall body which is arranged at a position inside the support body.

Further, in the display device according to the present invention, the partition wall body may be arranged to extend substantially parallel to the support body.

Further, in the display device according to the present invention, the height of the partition wall body may be set to be substantially equal to the height of the support body.

Here, the partition wall body may have a face thereof which faces the getters formed in an uneven shape. Further, the partition wall body also may be used as an electrode clamper, which holds the control electrodes. Still further, the control electrodes may be constituted of a plurality of strip-like electrode elements which are arranged in parallel to each other. In addition, the getters may be formed of dispersion getters.

Further, the display device according to the present invention comprises a face substrate having anodes and phosphors formed on an inner surface thereof, and a back substrate having a plurality of cathode lines which extend in one direction and are arranged in parallel in another direction which crosses the one direction and include electron sources, and control electrodes which cross the cathode lines in a display region in a non-contact manner and have electron passing apertures for allowing electrons from the electron sources to pass through the control electrodes to the face substrate side. The back substrate is disposed so as to face the face substrate in an opposed manner with a given distance therebetween, and a support body is interposed between the face substrate and the back substrate so that the support body surrounds the display region and maintains a given distance between the substrate. A sealing material is disposed so as to hermetically seal the end faces of the support body and face substrate and the back substrate respectively, and getters are arranged between the support body and the control electrodes, while, at the same time, an insulation film which covers the cathode lines is arranged between the support body and the control electrodes.

Further, in the display device according to the present invention, the insulation film may be arranged such that the insulation film extends in another direction.

Further, the display device according to the present invention may be constituted such that the insulation film may cover the whole surface between the support body and the control electrodes. Further, the display device according to the present invention may be provided with a partition wall body which holds the control electrodes.

Due to such constitutions, it is possible to provide a display device having a long lifetime and which can ensure a desired degree of vacuum, thus realizing a high reliability of hermetic sealing.

It should be understood that the present invention is not limited to the above-mentioned constitutions and to the constitution of the embodiments to be described later, and that various modifications can be made without departing from the technical concept of the present invention.

DESCRIPTION OF THE PREFERRED EMBODIMENTS

Figure 1:
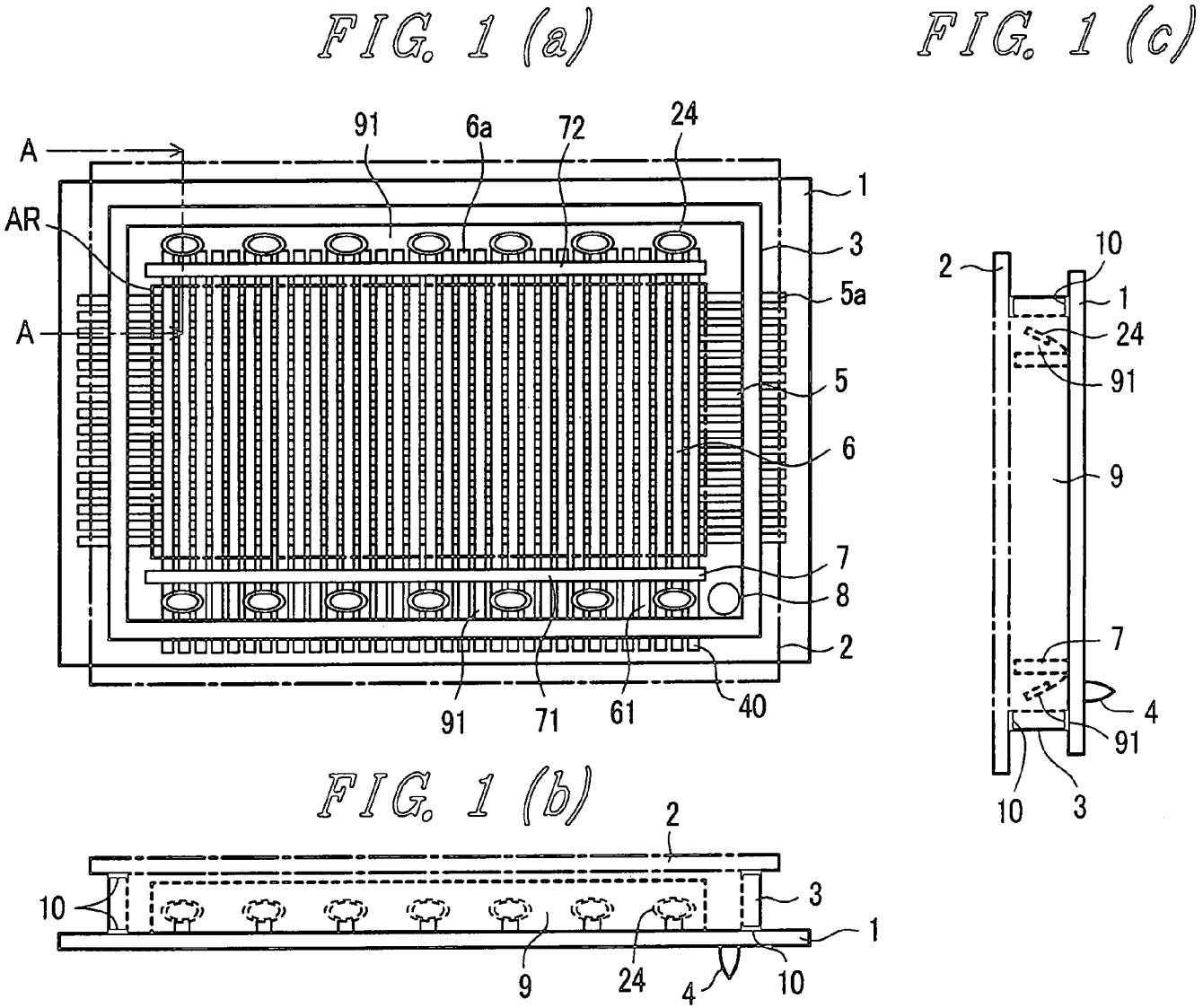
FIG. 1(*a*) to FIG. 1(*c*) are a top plan and respective side views showing one embodiment of a display device according to the present invention, wherein FIG. 1(*a*) is a plan view as seen from the face substrate side, FIG. 1(*b*) is a front view, and FIG. 1(*c*) is a side view.
Figure 2:
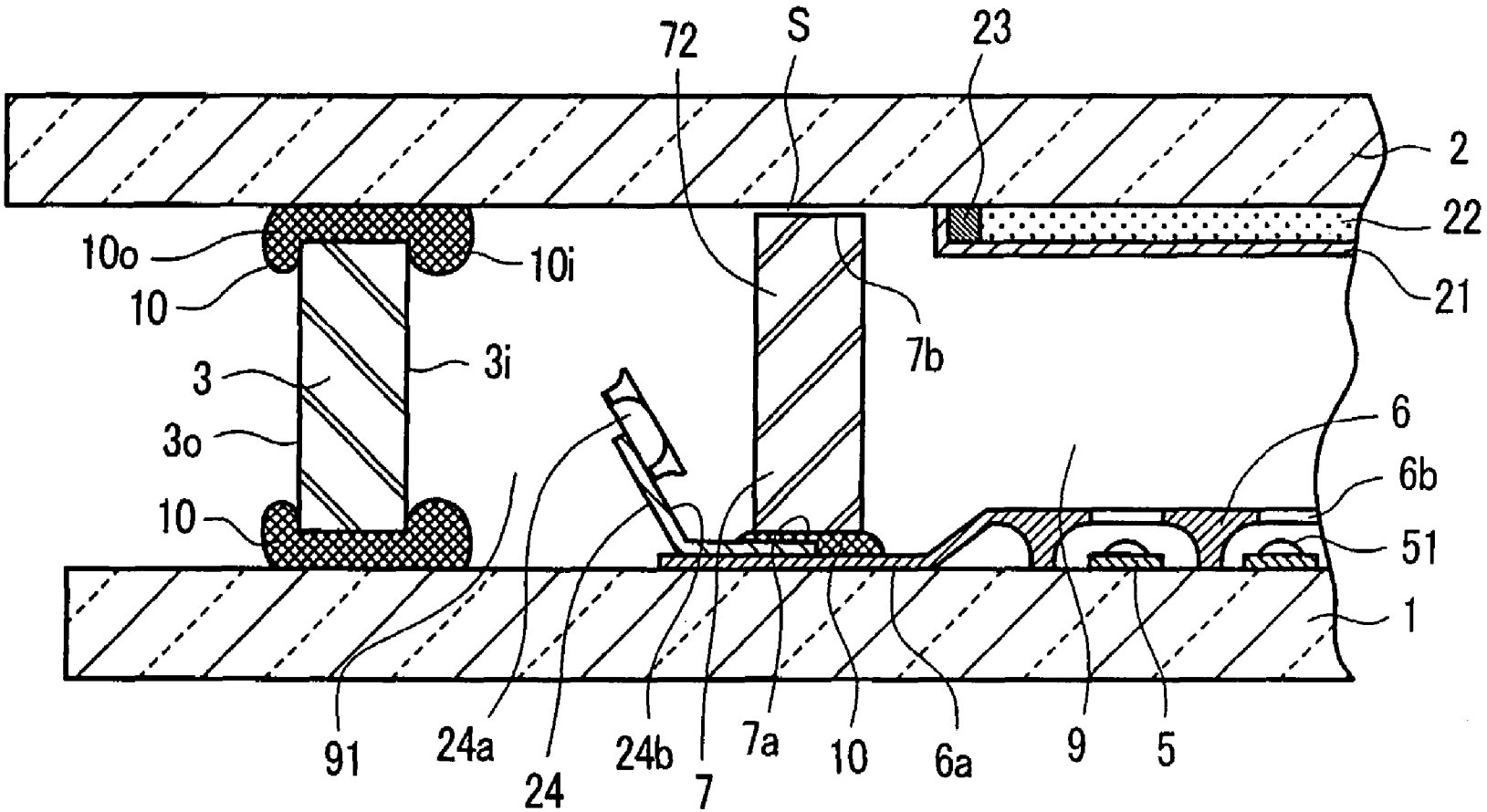
FIG. 2 is a cross-sectional view taken along a line A-A in FIG. 1(*a*)

Preferred embodiments of the present invention will be explained in detail hereinafter in conjunction with the drawings which show these embodiments. FIG. 1(*a*) is a plan view as seen from the face substrate side, FIG. 1(*b*) is a front view and FIG. 1(*c*) is a side view of a field emission type display device representing one embodiment of the present invention. FIG. 2 is a schematic cross-sectional view taken along a line A-A in FIG. 1(*a*). In FIG. 1(*a*) to FIG. 1(*c*) and FIG. 2, numeral 1 indicates a back substrate and numeral 2 indicates a face substrate, wherein the back substrate 1 and the face substrate 2 are stacked in the z direction. Here, z indicates the direction which is orthogonal to the substrate surfaces of the back substrate 1 and the face substrate 2. Numeral 3 indicates a support body, which also functions as an outer frame, wherein the support body 3 is interposed in a space defined between opposing surfaces of the back substrate 1 and the face substrate 2 in such a way that the support body 3 surrounds a display region AR. Numeral 4 indicates an evacuation tube.

The back substrate 1, in the same manner as the face substrate 2, is constituted of an insulation film which is preferably made of glass or a ceramic material, such as alumina, and has a plate thickness of several mm, for example, approximately 3 mm. On a front surface of the back substrate 1, a plurality of cathode lines 5, which have electron sources disposed thereon, are formed such that the cathode lines 5 extend in one direction (x direction) and are arranged in parallel in another direction (y direction) which crosses the one direction. The cathode lines 5 are formed by patterning a conductive paste containing silver or the like by printing or the like. End portions of the cathode lines 5 are extended out to the outside of the support body 3, which also functions as the outer frame, and they constitute cathode-line lead lines 5*a*. On each cathode line 5, the electron source 51, which is formed of a material selected from a group consisting of a metal-insulator-metal (MIM) type electron emission element, an electron emission structural element which utilizes an electron emission phenomenon based on a quantum theory tunneling effect (also referred to as "surface conduction type electron source,), a diamond film, a graphite film, carbon nanotubes and the like, is formed.

Further, above the cathode lines 5 (the face substrate 2 side), control electrodes 6 are arranged close to the cathode lines 5 by a distance approximately not greater than 0.1 mm, for example. The cathode lines 5 and the control electrodes 6 are arranged to cross each other at least over the whole area of the display region AR, while they are insulated from each other.

In this embodiment, as an example of the control electrodes 6, the constitution is adopted in which a large number of strip-like electrode elements (metal ribbons) 61, each of which has a plurality of electron passing apertures 6*b*, are arranged in parallel. Inventors of the present invention et al. have proposed this constitution in the course of the development arriving at the present invention. These strip-like electrode elements 61 are formed of iron-based stainless steel or an iron material. With respect to the size of the strip-like electrode element 61, the plate thickness is approximately 0.025 mm to 0.150 mm, for example. The control electrodes 6 are constituted of these strip-like electrode elements 61, which extend in the y direction and are arranged in parallel in the x direction.

Figure 14:
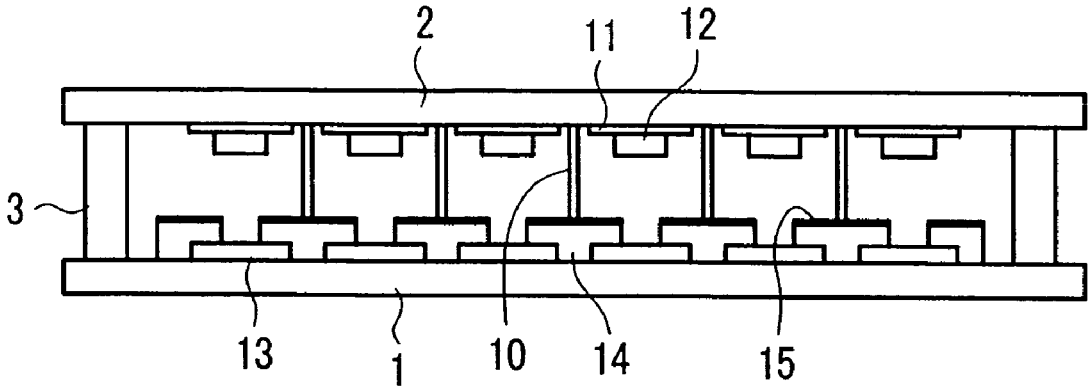
FIG. 14 (PRIOR ART)
FIG. 14 is a cross-sectional view showing an example of a field emission type display device.
Figure 15:
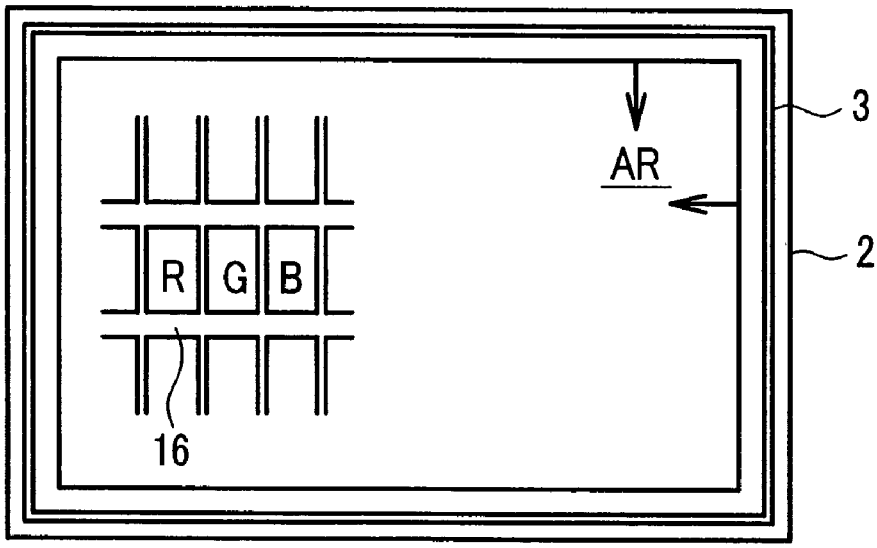
FIG. 15 (PRIOR ART)
FIG. 15 is a diagrammatic plan view of a field emission type display device of the type shown in FIG. 14.

With respect to these plate-like control electrodes 6, compared to the formation of control electrodes by vapor deposition of a metal thin film on an insulation layer, as described in conjunction with FIG. 14, the strip-like control electrodes 6 have the following features. That is, it is possible to easily ensure the uniform distance between the control electrode 6 and the cathode line 5, and the control characteristics of respective pixels can be made uniform over the whole area of the display region, whereby an image display of high quality can be obtained.

The plate-like control electrode 6 is arranged to be above (the face substrate side) and close to the cathode lines 5 having the electron sources disposed thereon; and, at the same time, a lead line 40 is connected to each plate-like control electrode 6 in the vicinity of the support body 3, which also functions as the outer frame. The lead line 40 is pulled out to an outer periphery of the display device and is connected to an external circuit. The control electrode lead line 40 may be formed by extending the strip-like electrode 61.

The electron source 51 and the electron passing aperture 6*b* are configured to be respectively arranged in an opposed manner at an intersecting portion between the cathode line 5 and the plate-like electrode 6. Further, each plate-like control electrode 6 has the vicinities of both end portions 6*a* thereof fixed to the back substrate 1 by partition wall bodies 7 (71, 72), which are respectively provided at the outside of the effective display region AR and at the inside of the support body 3, which also functions as the outer frame, wherein the partition wall bodies 7 (71, 72) also function as electrode clampers.

The partition wall bodies 7 are, in the same manner as the support body 3, constituted of an insulation body which is made of glass, ceramic or the like. The height of the partition wall bodies 7 is set to be substantially equal to the height of the support body 3, that is, approximately 3 mm. Further, in a state in which the support body 3 and both substrates 1, 2 are sealed together, a minute gap S of approximately not greater than 1 mm, for example, is formed between the partition wall body 7 and the inner surface of the face substrate 2. Further, the cross section of the partition wall bodies 7 is preferably set to have a square shape or a rectangular shape in the direction orthogonal to a long axis thereof.

Numeral 8 indicates an evacuation hole, and this evacuation hole 8 is formed in the back substrate 1, wherein the evacuation hole 8 has one end thereof in communication with an inner space 9 and another end in communication with an evacuation tube 4.

The inner space 9 indicates a space defined by the back substrate 1, the face substrate 2, which is stacked on the back substrate 1 in the z direction, and the support body 3, which is interposed in the gap between opposing faces of the both substrates and surrounds the display region. The inner space 9 is hermetically sealed by a sealing material 10 and is evacuated to a given degree of vacuum.

Here, the sealing material 10 is formed of a glass material which has a composition consisting of 75 to 80 wt % of PbO, approximately 10 wt % of $B_2O_3$ and 10 to 15 wt % of a balance and also contains amorphous type frit glass. The sealing material performs hermetic sealing of the support body 3 and both substrates 1, 2 as described above.

In this embodiment, the sealing material 10, after the hermetic sealing, has a portion thereof bulging from an inner side surface 3*i* which differs in shape from a portion thereof which bulges from an outer side surface 3*o* of the support body 3. That is, the bulging portion 10*i*, which protrudes from the inner side surface 3*i* at the display region side, is thicker than the bulging portion 10*o*, which protrudes from the outer side surface at a side opposite to the display region side.

Further, the cross section in the z direction of the bulging portion 10*i* is formed to have a shape close to a portion of an ellipse and exhibits a shape which projects in the counter substrate direction. On the other hand, the bulging portion 10*o*, which bulges from the outer side surface 3*o* opposite to the bulging portion 10*i*, has a shape close to that of a wedge.

Further, the size of the bulging portion 10*i* in a direction toward the inside of the panel is set to be larger than the size of the opposite bulging portion 10*o* in a direction toward the outside.

Further, in this embodiment, the length of the bulging portion 10*i* in a direction from an end face of the support body 3 toward the opposite substrate is set to be greater than the length of the opposing projecting portion 10*o* in a direction toward the opposite substrate.

Although the bulging portions exhibit various shapes depending on various factors, such as the composition of the sealing material 10, the heating temperature at the time of sealing, the pressure applied at the time of sealing and the like, an optimum shape may be selected based on the arrangement and position of the getters, the desired degree of vacuum, the sizes of substrate and electrodes and the like.

The sealing material 10 may be used at the time of fixing and holding both end portions 6*a* of the control electrodes 6 to the back substrate 1 by means of the partition wall bodies 7. Due to such fixing, the coaxial property or the alignment of the electron source 51 and the electron passing aperture 6*b* can be enhanced.

One or a plurality of electron passing apertures 6*b* can be arranged coaxially with the electron source 51 at the portion where the cathode line 5 and the control electrode 6 intersect, and these electron apertures 6*b* allow the electrons from the electron source 51 to pass therethrough to the anode 21 side. The interval between the anode 21 and the control electrode 6 is set to several mm, that is, approximately 3 mm, for example. In this embodiment, the anodes 21 also function as a metal back film.

Under such a constitution, the electrons which are emitted from the electron source 51 pass through the electron passing aperture 6*b* of the control electrode 6, to which a grid voltage of the approximately 100V is applied, thus being subjected to control. Then, the electrons impinge on the phosphor 22, which is covered with the anode 21 of the face substrate 2, to which an anode voltage of several KV to 10 and more kV is applied, so as to make the phosphor 22 emit light, whereby the display device produces a given display. Here, numeral 23 indicates a black matrix (BM) film. In this embodiment, a phosphor screen, which is constituted of the BM film 23, the phosphors 22 and the anodes 21, has substantially the same constitution as the phosphor screen of a conventional color cathode ray tube.

Further, numeral 24 indicates getters. The getters 24 are dispersion getters, that is, they are evaporation type getters, such as Ba getters. A plurality of getters 24 are respectively arranged in a space 91 that is defined between the support body 3 and the partition wall bodies 71, 72.

The getter 24 includes a getter vessel 24*a* and a getter support 24*b*, and it is configured such that the getter material scattering direction of the getter vessel 24*a* is directed to the partition wall body 7 side, and the getter support 24*b* is fixed to and held by the partition wall body 7. The fixing and holding of the getter is performed such that, between the lower end side 7*a* of the partition wall body 7 and the back substrate 1, the getter support 24*b* and the control electrode 6 are sandwiched together, and they are simultaneously or individually fixed and held by adhesion using the sealing material 10.

The getters 24 preferably have the property to withstand a high temperature of approximately 450° C., for example. That is, at the time of forming the panel by sealing both substrates and the support body, the getters 24 are exposed to a high temperature of several hundreds of degrees in the atmosphere, and, hence, the getters 24 are required to withstand such a temperature.

Further, the size of the getter 24 is set such that the diameter of the getter vessel 24*a* is approximately 5 mm, for example, and the thickness of the getter vessel 24*a* is approximately 1 mm, for example. The getters 24 are arranged at an interval of approximately 50 mm, for example. The size and the number of getters 24 may be determined based on the size of the substrate, the getter quantity and the like. Further, non-evaporation type getters can be used together with evaporation type getters provided that the non-evaporation type getters are not of the low-temperature active type and are activated after the evacuation. The common use of these two types of getters is effective.

The getters 24 which are mounted in the panel are subjected to a getter flashing by high frequency heating using operational conditions, such as frequency, as will be described later, from the outside of the panel after evacuating the inside of the panel and chipping off the evacuation tube 4.

Accordingly, the getter material scatters in the space 91 to perform a getter action. That is, substantially most of the scattered getter material adheres to the surface of the partition wall body 7, and a remaining portion of the scattered getter material adheres to the surfaces of respective members, constituted of the support body 3, both substrates 1, 2 and the sealing material 10, which surround the space 91.

The space 91 has a gas absorption function which is performed by an applied getter vapor-deposited film after completion of the getter flashing and is facilitated by the presence of the minute gap S or the like. Further, this space 91 can be considered as a substantially hermetic space in view of the diameter of the evaporated particles at the time of getter flashing, and, hence, leaking of the getter material to the outside of the space 91 can be ignored.

Here, the getter material which adheres to the surfaces of the respective members which surround the space 91 by getter flashing has a certain conductivity. However, since the minute gap S of approximately not greater than 1 mm, for example, is present between a top surface 7*b* of the partition wall body 7 and the face substrate 2, the electrical insulation between both substrates 1, 2 can be ensured with respect to any path through the partition wall body 7.

On the other hand, with respect to a path through the support body 3, in the vicinity of a boundary between the bulging portion 10*i* of the sealing material 10 and the inner side surface 3*i* of the support body 3, the getter vapor-deposited film becomes discontinuous, and, hence, the insulation between both substrates 1, 2 by way of this path can be also ensured. That is, provided that the cross-sectional shape in the z direction of the bulging portion 10*i* of the sealing material 10, which projects from the inner side surface 3*i* at the display region side, is similar to a portion of substantially elliptical shape, as described previously, the getter film which is adhered to an area ranging from the inner side surface 3*i* to the inner surface of the face substrate 2 by getter flashing becomes discontinuous at the bulging portion 10*i*, and, hence, the insulation between both substrates 1, 2 by way of this path can be ensured.

Accordingly, lowering of the dielectric strength characteristics between the back substrate 1 and the face substrate 2 due to the scattering of the getter material can be prevented, and, hence, the getter material can sufficiently exhibit the getter action which is originally desired.

Further, since the getters 24 per se are fixed by the sealing material 10, there is no possibility that the getters 24 move inside the panel and damage other members.

Further, since the getter vessel 24*a* is exposed to the space 91, it is possible to heat only the getter vessel 24*a* in a concentrated manner, and, hence, this embodiment also has an advantage in that the heating time can be shortened and thermal damage to other members can be surely prevented.

Here, when there is a possibility that the getter material that has adhered to the back substrate 1 side generates short-circuiting of the strip-like electrode elements 61 of the control electrodes 6, which are respectively disposed outside the partition wall body 7, the short-circuiting can be prevented by preliminarily covering such portions with an insulation film.

With respect to the high frequency condition which is applied to the getter flash operation, it is preferable to set the high frequency to a value not greater than 500 kHz, for example. It is more preferable to set the high frequency to approximately 350 kHz in view of the operability.

Further, in the getter flashing operation, there may be a case in which a high frequency heating coil cannot be arranged close to the getters 24 in view of a restriction on the constitutions of the cathode lines 5, the electron sources 51, the control electrodes 6, the getters 24 and the like, the heat resistance and the like. In such a case, a ferrite core may be arranged inside of the high frequency heating coil so as to concentrate the high frequency. With such a constitution, an excessive input power is no longer necessary, and, hence, the installation cost can be reduced and an abnormal discharge phenomenon inside of the panel attributed to the high frequency can be suppressed.

Figure 3:
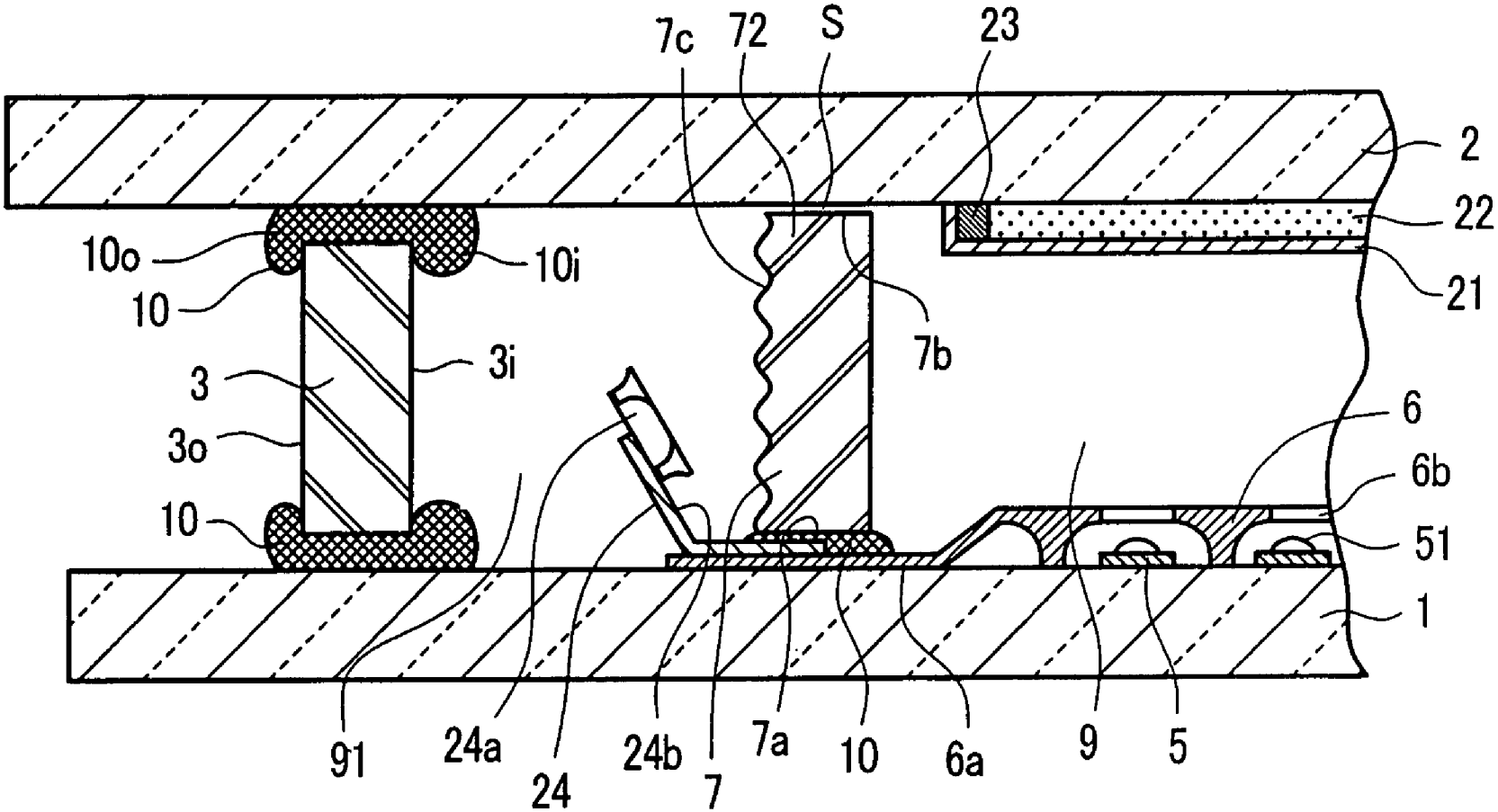
FIG. 3 is a cross-sectional view corresponding to FIG. 2 and showing another embodiment of the display device according to the present invention.

FIG. 3 is a view corresponding to FIG. 2, showing another embodiment of the display device according to the present invention. In FIG. 3, portions identical with the portions shown in FIG. 1(*a*) to FIG. 1(*c*) and FIG. 2 are identified by the same numerals. In FIG. 3, the outer surface 7C of the partition wall body 7, which faces the getters 24 in an opposed manner, is formed into an uneven shape, whereby the area to which a getter vapor-deposited film adheres can be increased. Further, the constitution shown in FIG. 3 also provides an increase in the creeping distance of the outer side surface 7C of the partition wall body 7.

Due to such a constitution, lowering of the dielectric strength characteristics between the back substrate 1 and the face substrate 2 caused by the scattering of the getter material can be prevented in the same manner as the previous embodiment, and, at the same time, along with the increase of the getter vapor-deposited film adhesion area between both substrates, the getter action is further enhanced, whereby the getters 24 can more completely perform the originally expected gas absorption action, thus facilitating the acquisition of the desired degree of vacuum.

By simultaneously forming the inner surface 3*i* of the support body 3 into an uneven shape along with the structure shown in FIG. 3, coupled with the increase of the getter material adhesion area, the creeping distance can be increased so that the dielectric strength characteristics along a path by way of the support body 3 can be further enhanced.

Figure 4:
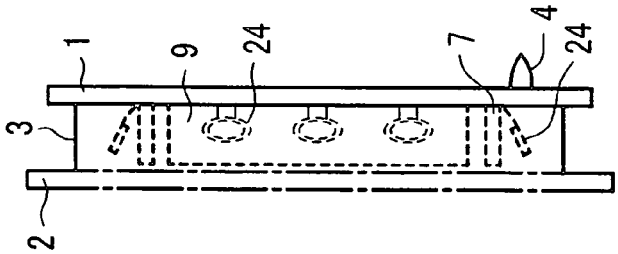
FIG. 4(*a*) to FIG. 4(*c*) are a top plan and respective side views showing still another embodiment of a display device according to the present invention, wherein FIG. 4(*a*) is a plan view as seen from the face substrate side, FIG. 4(*b*) is a front view, and FIG. 4(*c*) is a side view.
Figure 4:
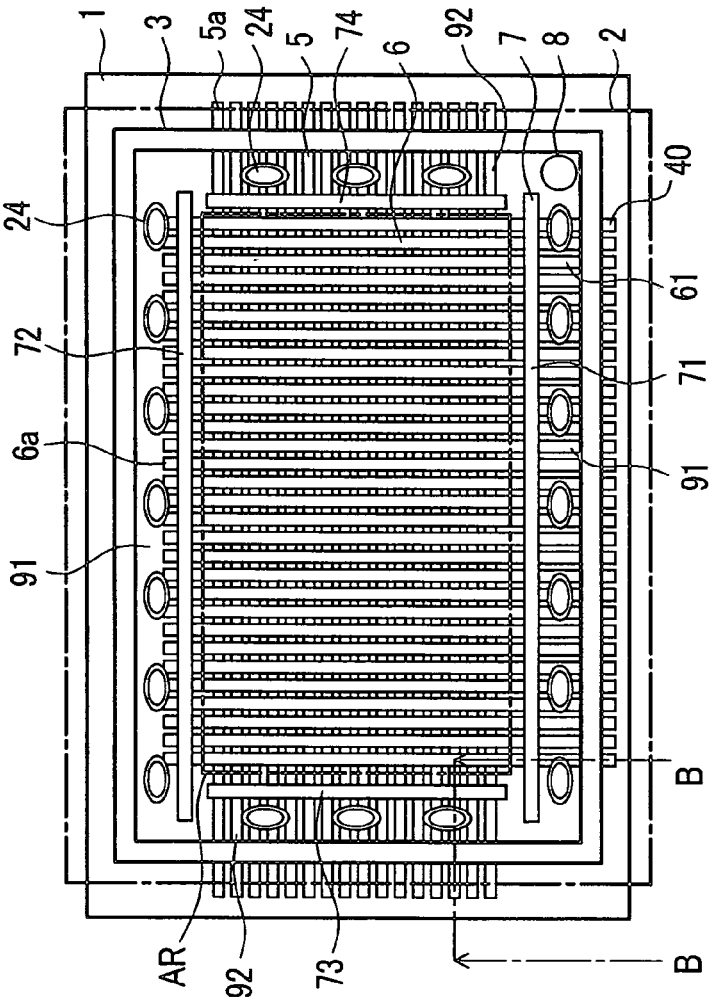
Figure 4:
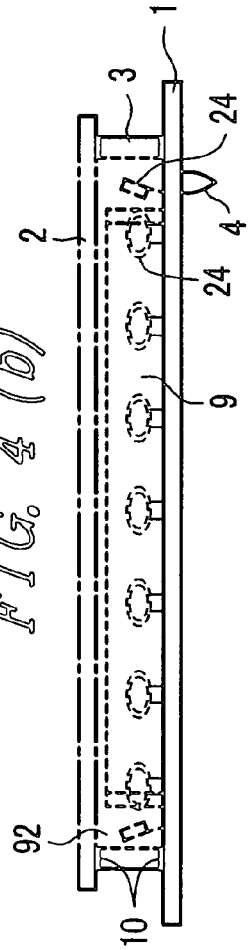
Figure 5:
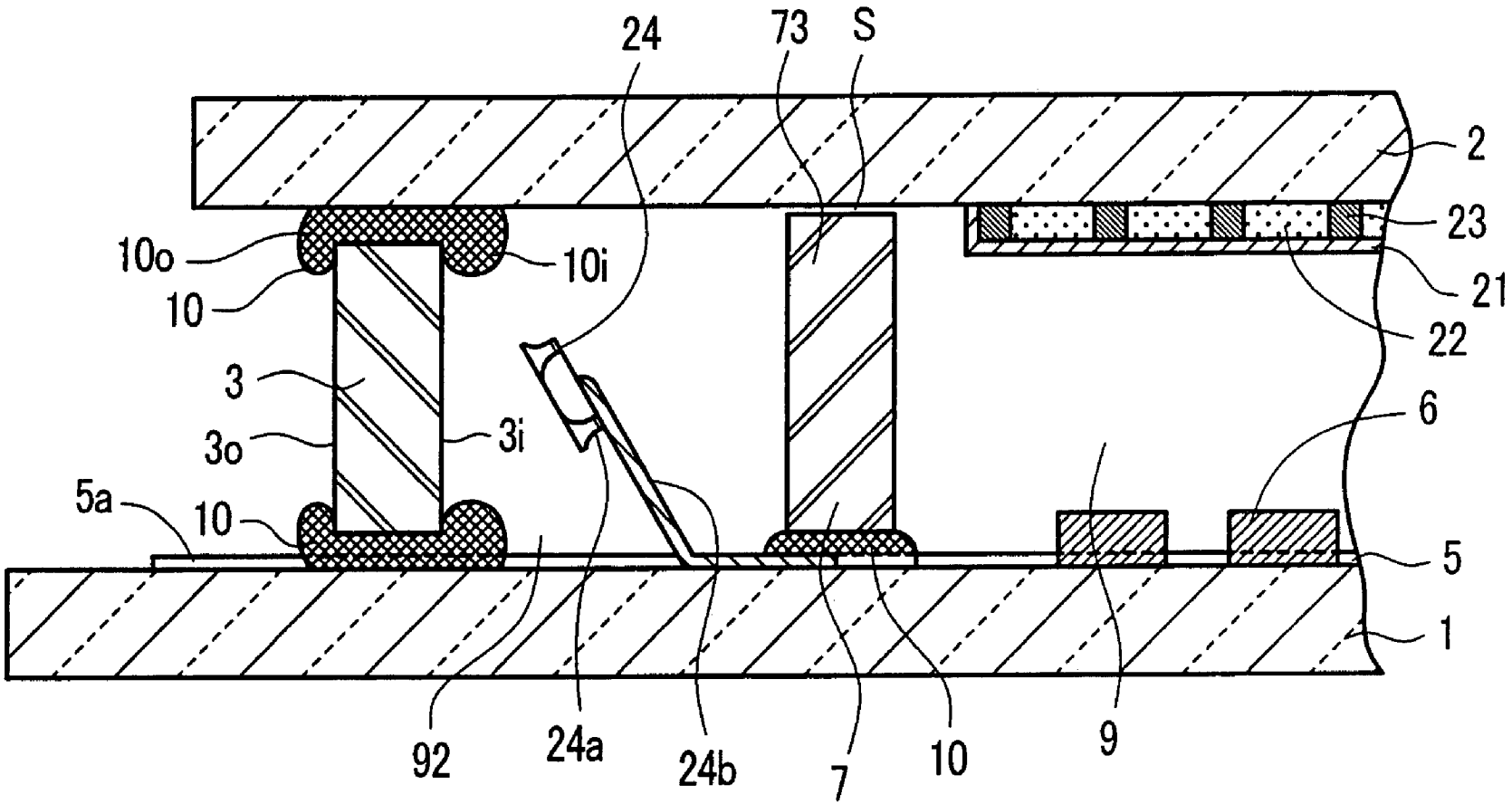
FIG. 5 is a cross-sectional view taken along a line B-B in FIG. 4(*a*)

FIG. 4(*a*) to FIG. 4(*c*) are views of a field emission type display device representing still another embodiment of the display device according to the present invention, wherein FIG. 4(*a*) is a plan view as seen from a face substrate side, FIG. 4(*b*) is a front view and FIG. 4(*c*) is a side view. Further, FIG. 5 is a cross-sectional view taken along a line B-B in FIG. 4(*a*). In these drawings, portions identical with the portions shown in FIG. 1(*a*) to FIG. 3 are identified by the same numerals.

As shown in FIG. 4(*a*) to FIG. 4(*c*) and FIG. 5, this embodiment is characterized in that partition wall bodies 7 (73, 74) are further arranged outside the control electrodes 6 in the direction parallel to the extending direction of the strip-like electrode elements 61, and getters 24 are also arranged in spaces 92 defined between the partition wall bodies 73, 74 and the support body 3.

The partition wall bodies 73, 74 have a height which is substantially equal to the height of the support body 3 and the partition wall bodies 71, 72, wherein the partition wall bodies 73, 74 have a size which allows, in the same manner as the partition wall bodies 71, 72, the formation of a minute gap S of approximately not greater than 1 mm, for example, between the inner surface of the face substrate 2 and the partition wall bodies 73, 74 in a state in which the support body 3 and both substrates 1, 2 are normally sealed to each other. Further, a cross section of the partition wall bodies 73, 74 orthogonal to the long axis is preferably formed to have a square shape or a rectangular shape in the same manner as the partition wall bodies 71, 72.

Further, in this embodiment, the getter material scattering direction of all of the getters 24 arranged in the spaces 91, 92 is directed toward the support body 3.

When the getter flashing operation is performed using such a constitution, substantially most of the getter material adheres to the inner surface of the support body 3, and a remaining portion of the scattered getter material adheres to the inner surfaces of respective members, consisting of the partition wall bodies 7 which surround the spaces 91, 92, both substrates 1, 2 and the sealing material 10, and the scattered getter material exhibits a getter action.

Here, the getter vapor-deposited films which adheres to the surfaces of the respective members which surround the spaces 91, 92 by getter flashing have a certain conductivity. However, since the minute gap S is present between the partition wall body 7 and the face substrate 2, the electrical insulation between both substrates 1, 2 can be ensured with respect to any path through the partition wall body 7.

On the other hand, with respect to a path through the support body 3, in the vicinity of a boundary between the bulging portion 10*i* of the sealing material 10 and the inner side surface 3*i* portion of the support body 3, the getter vapor-deposited film becomes discontinuous, and, hence, the electrical insulation between both substrates 1, 2 by way of this path can be also ensured.

That is, provided that the cross-sectional shape in the z-axis direction of the bulging portion 10*i* of the sealing material 10 from the inner side surface 3*i* at the display region side is similar to the portion of substantially elliptical shape, as described previously, the getter vapor-deposited film which adheres to an area ranging from the inner side surface 3*i* to the inner surface of the face substrate 2 by getter flashing becomes discontinuous at the bulging portion 10*i*, and, hence, the electrical insulation between both substrates 1, 2 by way of this path can be ensured.

Although the bulging portions exhibit various shapes depending on various factors, such as the composition of the sealing material 10, the heating temperature at the time of sealing, the pressure applied at the time of sealing and the like, an optimum shape may be selected based on the arrangement and position of the getters, the desired degree of vacuum, the sizes of the substrates and the electrodes and the like.

Accordingly, lowering of the dielectric strength characteristics between the back substrate 1 and the face substrate 2 due to the scattering of the getter material can be prevented, and, hence, the getter material can sufficiently exhibit the getter action which is originally desired.

Here, when there exists a possibility that the getter vapor-deposited film, adheres to the back substrate 1 side, may generate a short-circuiting between the cathode lines 5 and the strip-like electrode elements 61 of the control electrodes 6, which are respectively disposed outside the partition wall body 7, the short-circuiting can be prevented by preliminarily covering such portions with an insulation film.

On the other hand, by directing the getter material in a scattering direction toward the support body 3 side, substantially most of the scattered getter material will adhere to the vicinity of the inner surface of the support body 3, and, hence, the amount of the getter which wraps around to the phosphor side becomes small, whereby the influence thereof on the phosphor screen can be further ignored.

Figure 6:
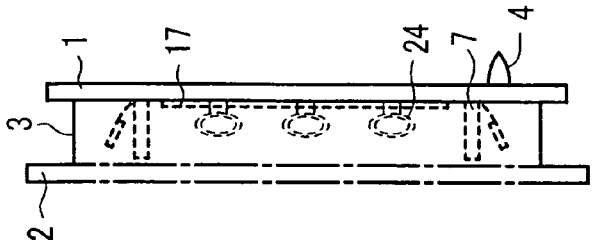
FIG. 6(*a*) to FIG. 6(*c*) are a top plan and respective side views showing still another embodiment of a display device according to the present invention, wherein FIG. 6(*a*) is a plan view as seen from the face substrate side, FIG. 6(*b*) is a front view, and FIG. 6(*c*) is a side view.
Figure 6:
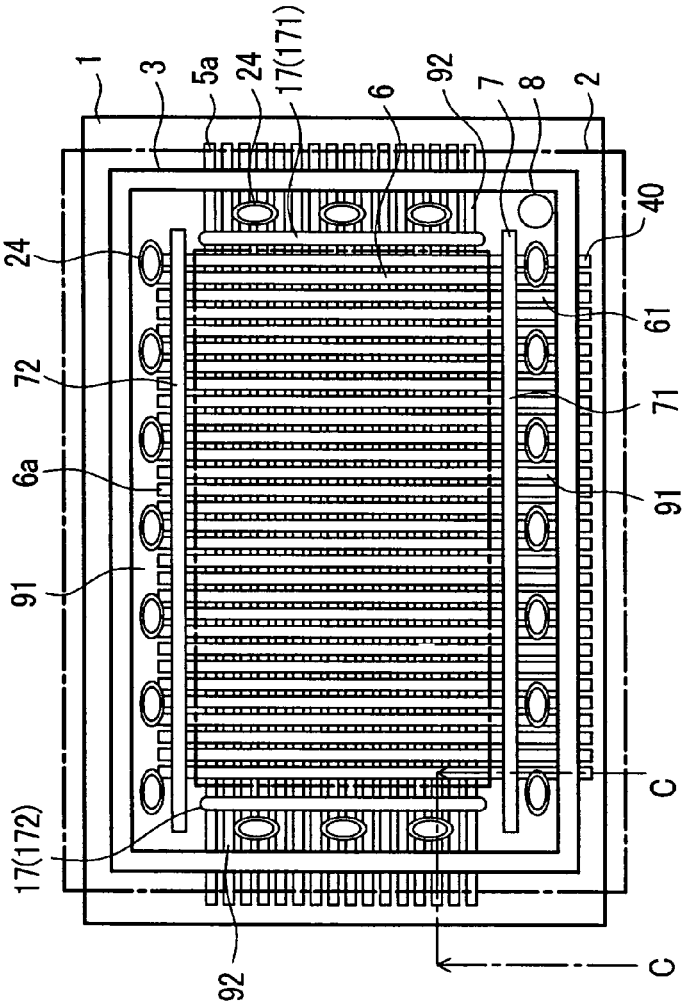
Figure 6:
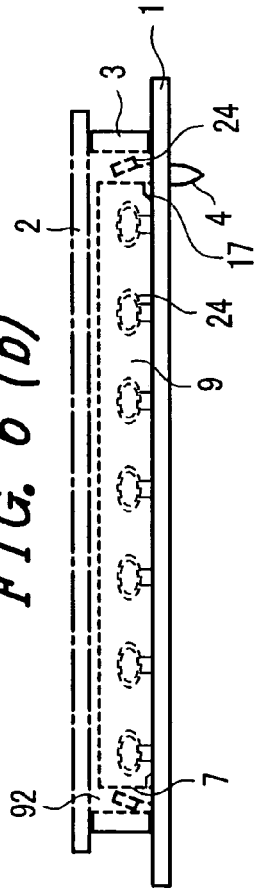
Figure 7:
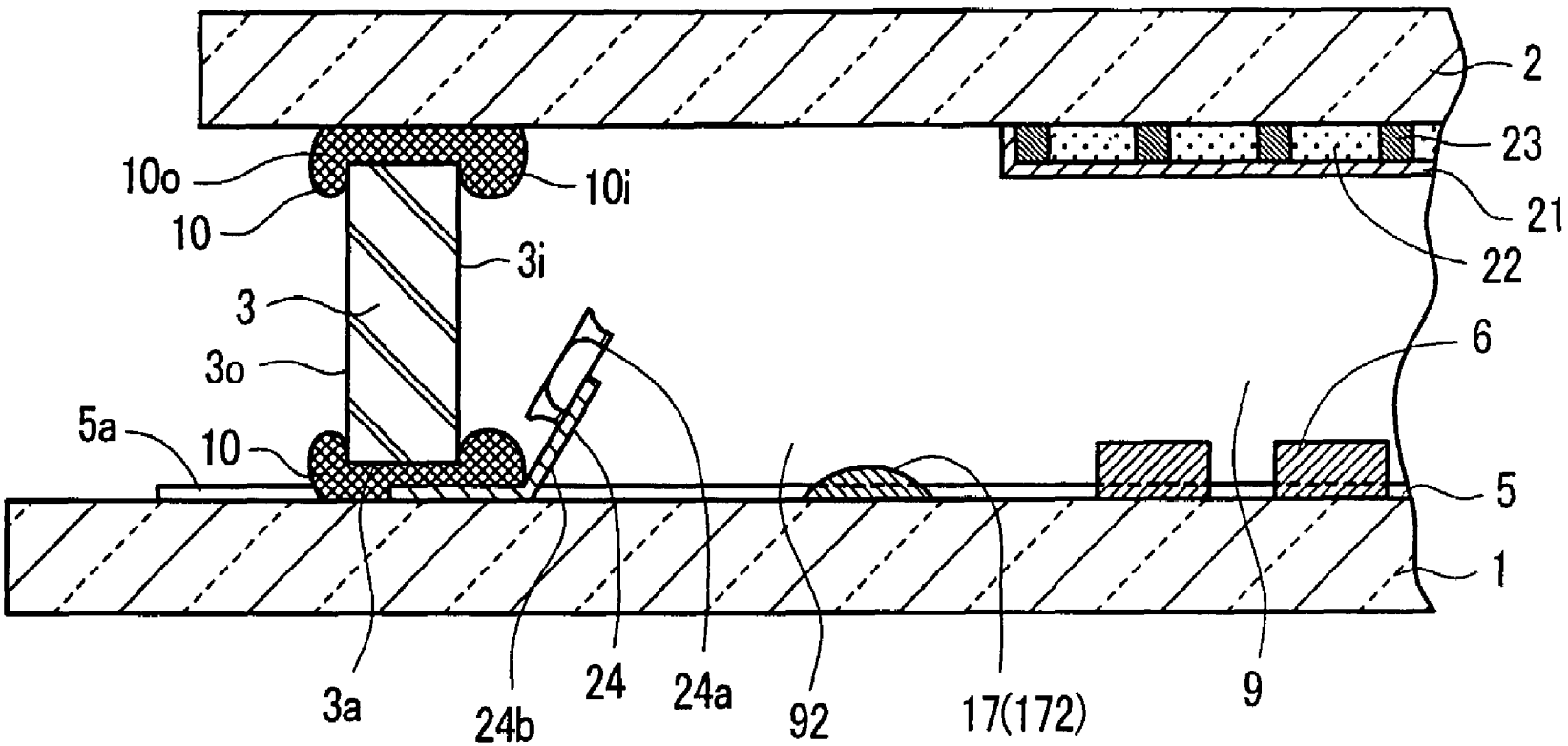
FIG. 7 is a cross-sectional view taken along a line C-C in FIG. 6(*a*)

FIG. 6(*a*) to FIG. 6(*c*) are views of a field emission type display device representing still another embodiment of a display device according to the present invention, wherein FIG. 6(*a*) is a plan view as seen from the face substrate side, FIG. 6(*b*) is a front view and FIG. 6(*c*) is a side view. Further, FIG. 7 is a cross-sectional view taken along a line C-C in FIG. 6(*a*). In these drawings, elements which are identical with the elements shown in FIG. 1(*a*) to FIG. 5 are identified by the same numerals.

As shown in FIG. 6(*a*) to FIG. 6(*c*) and FIG. 7, this embodiment is characterized in that strip-like insulation films 17 (171, 172) are arranged at given positions outside the control electrodes 6 in a direction parallel to the extending direction of the strip-like electrode elements 61, such that the strip-like insulation films 17 (171, 172) traverse and cover the cathode lines 5, and the getters 24 are arranged in spaces 92.

It is preferable to set the positions where the strip-like insulation films 17 (171, 172) are formed to positions where the wrap-around quantity of a getter vapor-deposited film becomes maximum when the getters 24 are mounted such that the getter material scattering is directed toward the support body 3 side.

The getters 24 are configured such that the getter material scattering direction of the getter vessels 24*a* is toward the support body 3 side, and the getter supports 24*b* are fixed to and held by the support body 3.

The fixing and holding is performed such that, between the lower end side 3*a* of the support body 3 and the back substrate 1, the getter supports 24*b* are sandwiched and fixed by adhesion using the sealing material 10.

When getter flashing is performed using such a constitution, the getter material exhibits a getter action such that substantially most of the scattered getter material adheres to the inner surface of the support body 3 in the space 92, a remaining portion of the getter material adheres to the inner surfaces of the respective members consisting of both substrates 1, 2, which surround the space 92 and the sealing material 10, and, further, a portion of the getter material adheres to a metal back 21 of the phosphor surface.

Here, although the getter vapor-deposited film which adheres to the inner surfaces of respective members due to getter flashing has a conductivity, the getter vapor-deposited film which has adhered to the inner surface side of the support body 3 becomes discontinuous in the vicinity of a boundary between a portion of the bulging portion 10*i* of the sealing material 10 and a portion of the inner side surface 3*i* of the support body 3, and, hence, electrical insulation between both substrates 1, 2 can be ensured.

On the other hand, the getter vapor-deposited film which has adhered to the metal back 21 of the phosphor surface 21 becomes discontinuous in the vicinity of a boundary between the bulging portion 10*i* of the sealing material 10 and the inner side surface 3*i* portion of the support body 3, and, hence, no adverse influence is generated with respect to the dielectric strength. Rather, this constitution gives rise to an advantageous effect in that the getter deposited film adheres to the face substrate 1 and contributes to the enhancement of the contrast of the phosphor surface.

Further, with respect to the getter vapor-deposited film which is wrapped around to the cathode line 5 side, since the cathode lines 5 are covered with the strip-like insulation films 17 (171, 172), electrical insulation between the cathode lines 5 can be ensured.

Also, by forming the strip-like insulation films 17 (171, 172) over a wide range from the inner side surface 3*i* of the support body 3 to the vicinity of the control electrode 6, electrical insulation between the cathode lines 5 can be ensured more reliably.

In this embodiment, the getters 24 are constituted such that the getter material scattering direction of the getter vessel 24*a* is toward the support body 3 side, the getter support 24*b* is sandwiched between an upper end side 7*b* of the support body 3 and the face substrate 2 and is fixed to and held by the front substrate 2 by adhesion using the sealing material 10.

Figure 8:
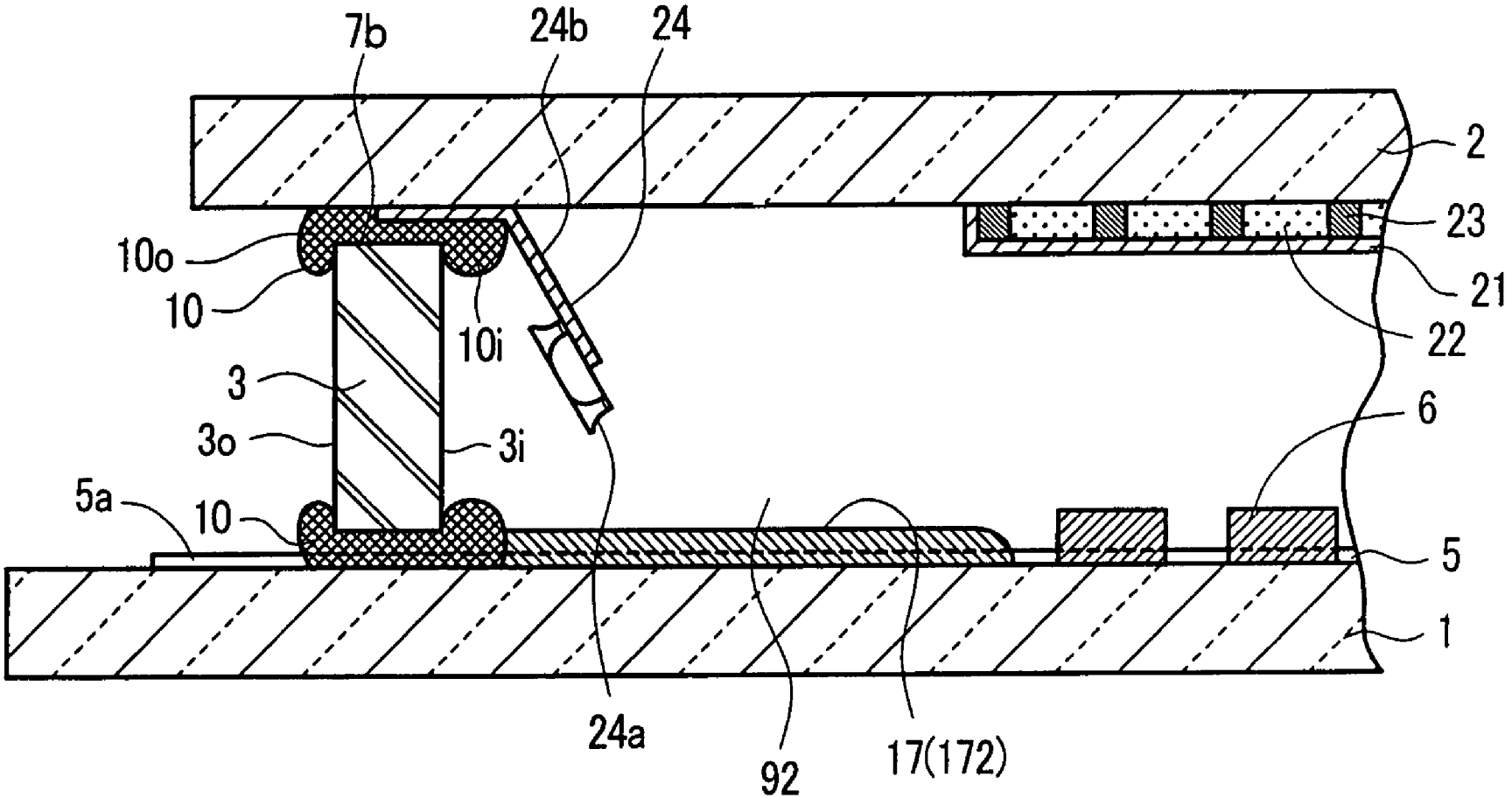
FIG. 8 is a cross-sectional view corresponding to FIG. 7 and showing still another embodiment of the display device according to the present invention.

FIG. 8 is a cross-sectional view corresponding to FIG. 7, showing still another embodiment of the display device according to the present invention; in which the getter 24 is mounted on the face substrate 2 side of the support body 3 and the strip-like insulation film 17 (171, 172) is extended to the support body 3 on the back substrate 1.

Here, due to the above-mentioned constitutions of the embodiments shown in FIG. 6(*a*) to FIG. 8, the conductance of the space side 92 at the time of evacuation can be improved, the evacuation time can be shortened, and the obtainable degree of vacuum can be highly elevated. Further, due to a combination of the above-mentioned advantageous effects and the getter action obtained by the getter vapor-deposited film, the desired degree of vacuum can be easily ensured.

Figure 9:
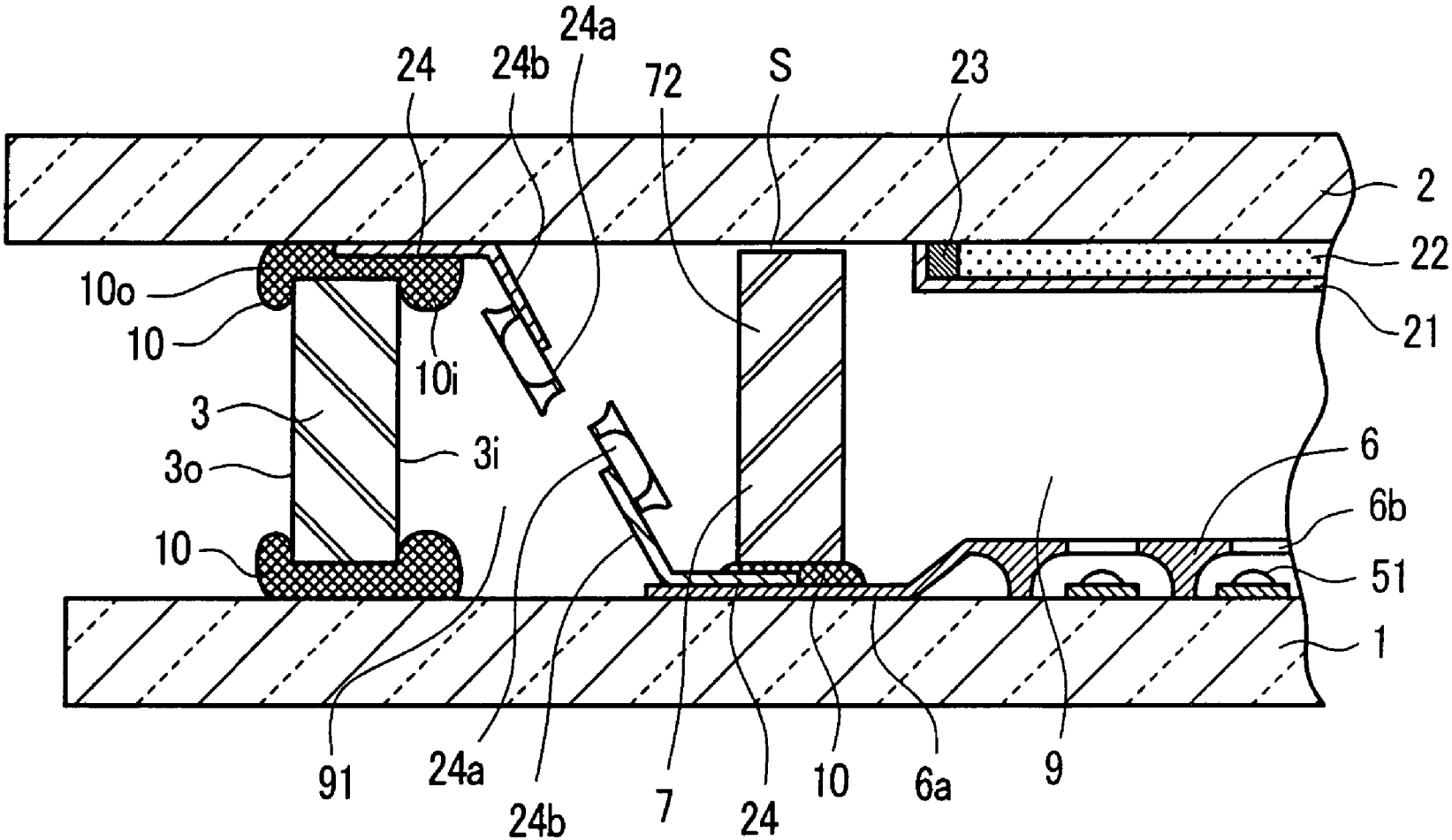
FIG. 9 is a cross-sectional view corresponding to FIG. 2 and showing still another embodiment of the display device according to the present invention.

FIG. 9 is a cross-sectional view corresponding to FIG. 2, showing still another embodiment of the display device according to the present invention. This embodiment is characterized in that the quantity of the getter 24 is increased by providing a pair of getters 24, which are sandwiched between the support body 3 and the substrate, as well as between the partition wall body 7 and the substrate, respectively, and are fixed to and held by the substrates by adhesion using the sealing material 10.

Due to such a constitution, a lowering of the dielectric strength characteristics between the back substrate and the face substrate can be prevented in the same manner as described above. Further, since the getter vapor-deposited film adhesion area between both substrates is increased, the getter action is enhanced, whereby the getters can sufficiently exhibit the originally expected gas absorption action. Accordingly, it is possible to easily ensure the desired degree of vacuum.

Figure 10:
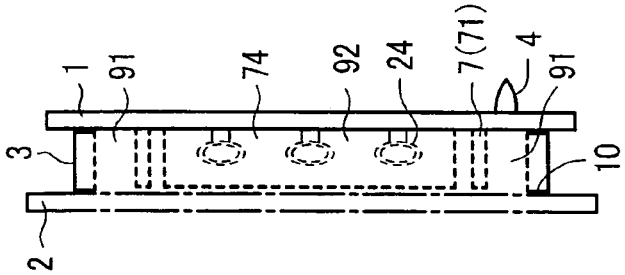
FIG. 10(*a*) to FIG. 10(*c*) are a top plan and respective side views showing still another embodiment of a display device according to the present invention, wherein FIG. 10(*a*) is a plan view as seen from the face substrate side, FIG. 10(*b*) is a front view, and FIG. 10(*c*) is a side view.
Figure 10:
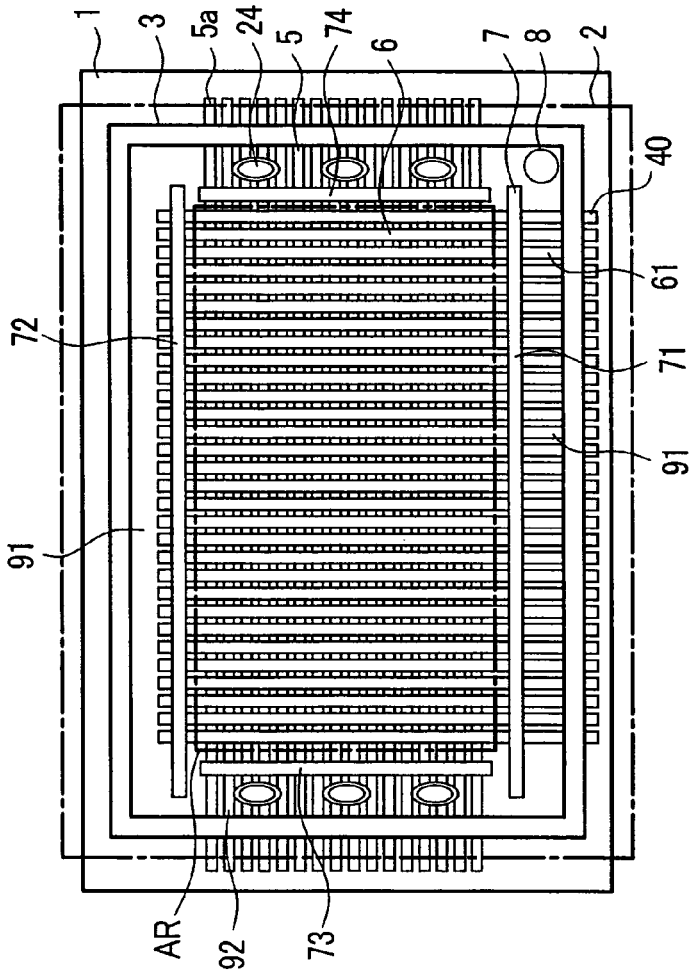
Figure 10:
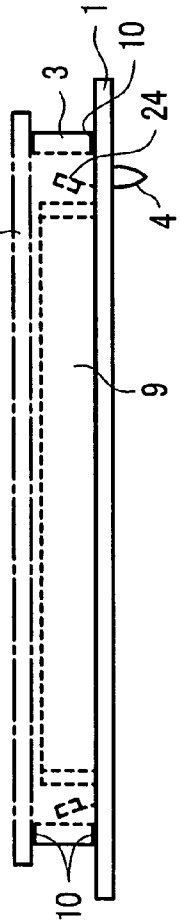

FIG. 10(*a*) to FIG. 10(*c*) are views of a field emission type display device representing still another embodiment of a display device according to the present invention, wherein FIG. 10(*a*) is a plan view as seen from the face substrate side, FIG. 10(*b*) is a front view and FIG. 10(*c*) is a side view. In these drawings, portions identical with the elements shown in FIG. 1(*a*) to FIG. 9 are identified by the same numerals.

The embodiment shown in FIG. 10 is characterized in that the getters 24 are arranged only between the partition wall bodies 73, 74 and the support body 3. That is, the getters 24 are arranged to extend in a direction which is equal to the extending direction of the strip-like electrode elements 6 and the support bodies 3, and the getters 24 are sandwiched between the partition wall bodies 73, 74 and the back substrate 1 and are fixed to and held by adhesion using the sealing material 10.

Due to such a constitution, the operation to fix the strip-like electrode elements 61 to the back substrate 1 using the partition wall bodies 71, 72, which also function as electrode clampers, is facilitated compared to the operation which seeks to simultaneously fix the getters 24. Further, the positional relationship between the strip-like electrode terminals 61 can be managed with a high accuracy.

On the other hand, since the cathode lines 5 are preliminarily formed on the back substrate 1 by means such as printing, at the time of fixing and holding the getters 24, the cathode lines 5 are subjected to no adverse influence.

Here, although the getters are configured to be sandwiched by the substrate and the support body or the partition wall body in the above-mentioned respective embodiments, it is needless to say that the getters may be configured to be fixed by adhesion to the side face of the support body or the partition wall body. In this side fixing, there may arise a case in which the fixing operation per se must be performed separately.

Figure 11:
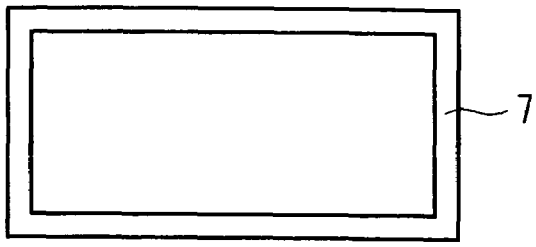
FIG. 11(*a*) to FIG. 11(*f*) are diagrammatic views showing structural examples of a partition wall body used in the display device according to the present invention, wherein FIG. 11(*a*) and FIG. 11(*b*) are respective plan views, FIG. 11(*c*) is a front view of another example, FIG. 11(*d*) is a cross-sectional view taken along a line D-D in FIG. 11(*c*), FIG. 11(*e*) is a front view of still another example, and FIG. 11(*f*) is a cross-sectional view taken along a line E-E in FIG. 11(*e*)
Figure 11:
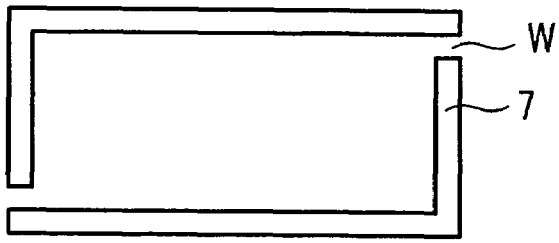
Figure 11:
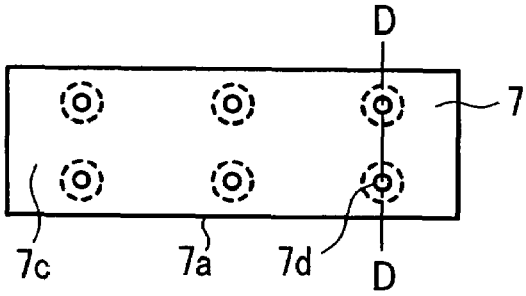
Figure 11:
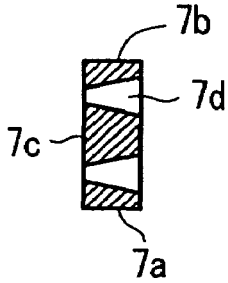
Figure 11:
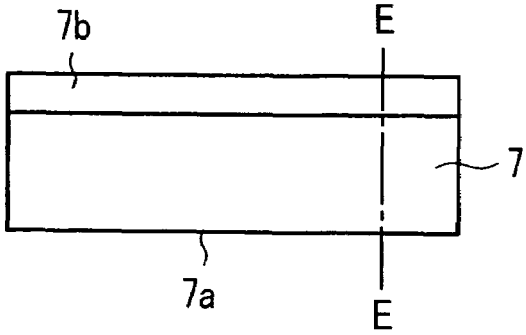
Figure 11:
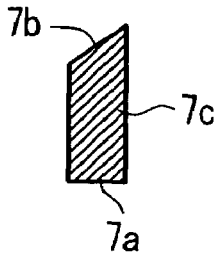

FIG. 11(*a*) to FIG. 11(*f*) are views showing structural examples of the partition wall body 7 used in the display device according to the present invention, wherein FIG. 11(*a*) and FIG. 11(*b*) are respective plan views, FIG. 11(*c*) is a front view of another example, FIG. 11(*d*) is a cross-sectional view taken along a line D-D in FIG. 11(*c*), FIG. 11(*e*) is a front view of still another example, and FIG. 11(*f*) is a cross-sectional view taken along a line E-E in FIG. 11(*e*).

The partition wall body 7 shown in FIG. 11(*a*) is of an integral frame type and is arranged at a desired position inside the support body 3. This constitution enhances the mechanical strength of the partition wall body 7 per se and, at the same time, facilitates handling of the partition wall body 7. Further, the positional relationship among respective sides can be accurately defined. Further, it is possible to improve the conductance at the time of evacuation by changing the height of respective sides individually.

On the other hand, the partition wall body 7 shown in FIG. 11(*b*) is of an L-shaped integral type in which two L-shaped partition wall bodies are combined. Alternatively, although not shown in the drawing, a combination of one piece of the L-shaped partition wall body and a rod-like partition wall body which extends along a single side may be used.

This constitution can facilitate handling of the partition wall body 7 compared to the partition wall body which is divided into four sections corresponding to four sides. This constitution also can improve the conductance at the time of evacuation by adjusting the distance W by changing the lengths of the sides.

Further, although not shown in the drawing, various constitutions are conceivable wherein a partition wall body which extends along three sides is formed into an integral U type and a rod-like partition wall body which extends along a single side is combined with the integral U type body.

Further, the partition wall body 7 shown in FIG. 11(*c*) and Fig. (d) is characterized in that apertures 7*d* are formed in the side wall, wherein the apertures 7*d* are formed into a tapered shape having a small diameter at the outer side surface 7*c* side and a large diameter at the opposite side. In such a constitution, although the vaporized getter material adheres to inner wall surfaces of the apertures 7*d* from the outer side surface 7*c* of the partition wall body 7 as a vapor-deposited film, it is possible to prevent the getter material from passing through the apertures 7*d* by controlling the apertures 7*d*. On the other hand, by providing a large aperture diameter at the gas generation source side of the inner side surface, the evacuation efficiency can be enhanced, whereby the desired degree of vacuum can be ensured.

Here, the shape of the apertures 7*d* is not limited to a circular shape, and various shapes, including an elliptical shape and a rectangular shape can be adopted.

The partition wall body 7 shown in FIG. 11(*e*) and FIG. 11(*f*) is characterized in that an inclination is given to the top face 7*b* in the direction descending from the outer side surface 7*c* side to the inner side surface side. In such a constitution, although there exists a possibility that the evaporated getter material will intrude into the display region side through a minute gap S defined between the top at the outer side surface 7*c* side and the face substrate 2, the intrusion amount can be substantially ignored. On the other hand, by increasing the gap at the gas generating source side of the inner side surface, the evacuation efficiency can be enhanced, whereby the desired degree of vacuum can be ensured.

Figure 12:
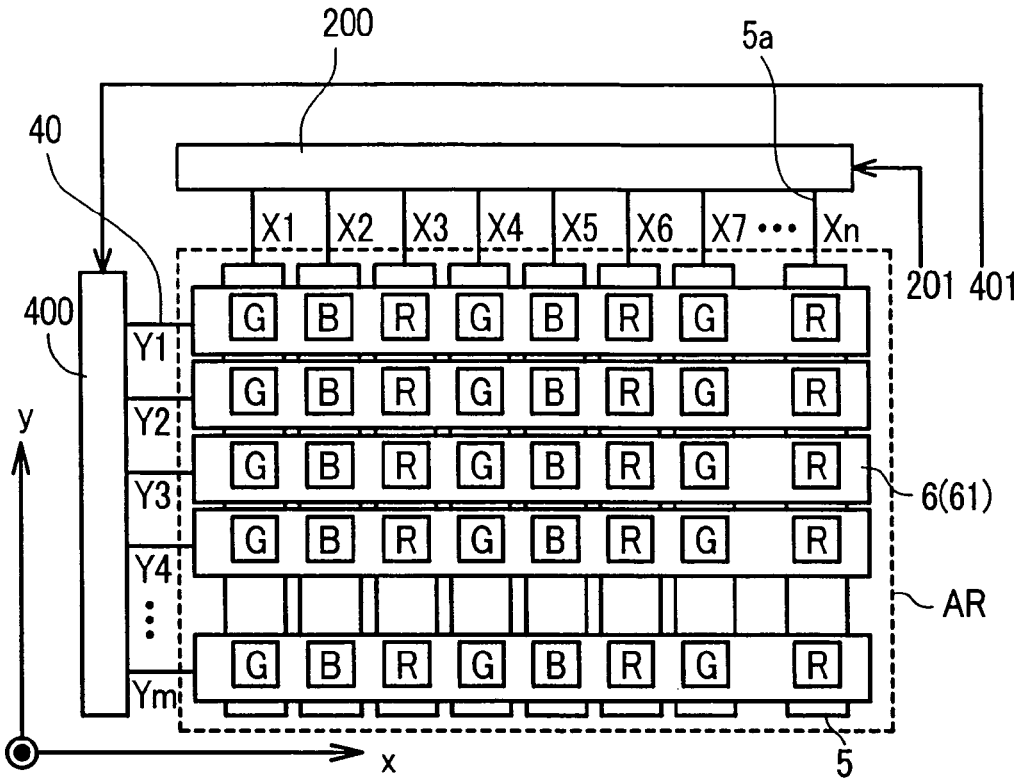
FIG. 12 is equivalent circuit diagram of an example of the display device according to the present invention.
Figure 13:
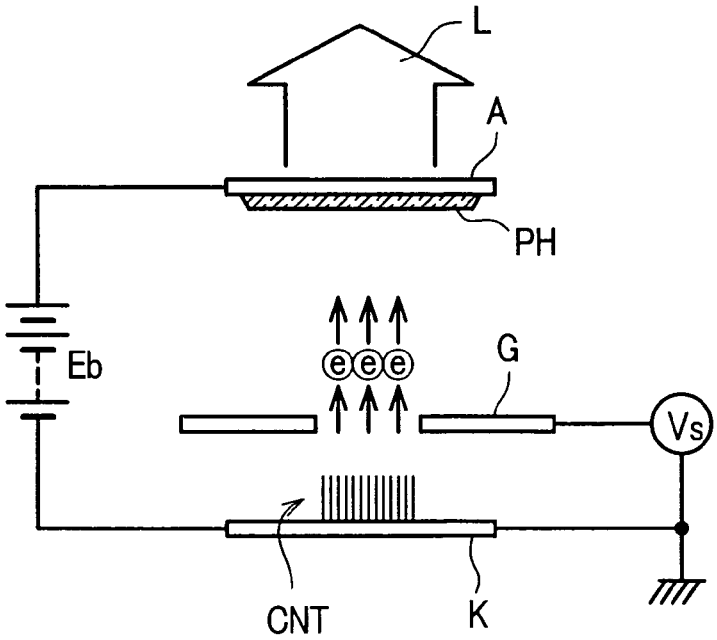
FIG. 13 (PRIOR ART)
FIG. 13 is a diagram illustrating the basic constitution of a field emission type display device.

FIG. 12 is an equivalent circuit diagram showing an example of the display device of the present invention. The region indicated by a broken line in the drawing indicates a display region AR. In the display region AR, the cathode lines 5 and the control electrodes 6 (strip-like electrode elements 61) are arranged to cross each other, thus forming a matrix of n×m lines. Respective crossing portions of the matrix constitute unit pixels, and one color pixel is constituted of a group of "R", "G", "B" pixels as seen in the drawing. The cathode lines 5 are connected to a video drive circuit 200 through the cathode line lead lines 5*a* (X1, X2, . . . Xn), while the control electrodes 6 are connected to a scanning drive circuit 400 through control electrode lead lines 40 (Y1, Y2, . . . Ym).

The video signals 201 are inputted to the video drive circuit 200 from an external signal source, while scanning signals (synchronous signals) 401 are inputted to the scanning drive circuit 400 in the same manner. Accordingly, the given pixels which are sequentially selected by the strip-like electrode elements 61 and the cathode lines 5 are illuminated with light of given colors so as to display a two-dimensional image. With the provision of the display device having such a construction, it is possible to realize a flat panel type display device which is operated by a relatively low voltage and, hence, exhibits a high efficiency.

As has been explained heretofore, the partition wall bodies which extend substantially in parallel to the support body are arranged outside the display region and inside the support body, and, at the same time, the getters are arranged in the spaces defined between the partition wall bodies and the support body. Accordingly, the adverse influence to other members attributed to getter flashing can be reduced, and, at the same time, the contamination of the electrodes and the like attributed to the getter flashing is hardly generated; and, hence, it is possible to surely and sufficiently ensure deposition of a getter vapor-deposited film having a gas absorption function over a wide range, whereby it is possible to provide a highly reliable display device which exhibits excellent dielectric strength characteristics, ensures the desired degree of vacuum and exhibits a long lifetime.

Further, the strip-like insulation films which extend substantially in parallel to the extending direction of the control electrodes are provided outside the control electrodes, and, at the same time, the getters are arranged between the support body and the control electrodes. Accordingly, the adverse influence to other members attributed to getter flashing can be reduced, and, at the same time, the short-circuiting of the electrodes attributed to the getter flashing can be prevented; and, hence, it is possible to surely and sufficiently ensure deposition of a getter vapor-deposited film having a gas absorption function over a wide range, whereby it is possible to provide the highly reliable display device which exhibits excellent dielectric strength characteristics, ensures the desired degree of vacuum and exhibits a long lifetime.

The invention claimed is:

1. A display device comprising:

a face substrate having anodes and phosphors formed on an inner surface thereof;

a plurality of cathode lines which extend in a first direction and are arranged in parallel in a second direction which crosses the first direction and include electron sources;

control electrodes which cross the cathode lines in a display region in a non-contact manner and have electron passing apertures for allowing electrodes from the electron sources to pass through the control electrodes to the face substrate side;

a back substrate on which the control electrodes and the cathode lines are formed on an inner surface thereof and face the face substrate in an opposed manner with a given distance therebetween;

a support body which is interposed between the face substrate and the back substrate in a state that the support body surrounds the display region and holds the given distance;

a sealing material which hermetically seals end faces of the support body and the face substrate and the back substrate respectively; and a plurality of getters; wherein:

the getters include a getter material, a getter vessel housing the getter material and a getter support supporting the getter vessel;

a partition wall body which extends parallel to the support body and is arranged from the support body internally and outside the display region and is fixed to the back substrate;

a gap is present between the partition wall body and the face substrate;

each getter is arranged between the support body and the partition wall body.

2. A display device according to claim 1, wherein the partition wall body is arranged to extend substantially parallel to the support body.

3. A display device according to claim 1, wherein a height of the partition wall body is set substantially equal to a height of the support body.

4. A display device according to claim 1, wherein the partition wall body has a face thereof which faces the getters formed in an uneven shape.

5. A display device according to claim 1, wherein the partition wall body is also used as an electrode damper which holds the control electrodes.

6. A display device according to claim 5, wherein the control electrodes are constituted of a plurality of strip-like electrode elements which are arranged in parallel to each other.

7. A display device according to claim 1, wherein the getters are formed of dispersion getters.

8. A display device according to claim 1, wherein the getter support is fixedly arranged between the support body and the face substrate or the back substrate or between the partition wall body and the back substrate.

9. A display device comprising:

a face substrate on which anodes and phosphors are formed on an inner surface thereof;

a back substrate on which a plurality of electron emission elements are formed on an inner surface thereof and face the face substrate in an opposed manner with a given distance therebetween;

a support body which is interposed between the face substrate and the back substrate such that the support body surrounds a display region;

an inner space defined by the back substrate, the face substrate and the support body;

a sealing material which hermetically seals end faces of the support body and the face substrate and the back substrate;

a getter including a getter material, a getter vessel housing the getter material and a getter support supporting the getter vessel; and a partition wall body arranged from the support body internally and fixed to the back substrate, wherein:

the inner space is evacuated, a gap is present between the partition wall body and the face substrate;

the getter is arranged between the support body and the partition wall body.

10. A display device according to claim 9, wherein the back substrate which have a plurality of cathode lines connecting a video drive circuit and have a plurality of control electrodes connecting a scanning drive circuit.

11. A display device according to claim 9, wherein the getter support is fixedly arranged between the support body and the face substrate or the back substrate or between the partition wall body and the back substrate.

* * * * *